US005293661A

United States Patent [19]

Appleby

[11] Patent Number: 5,293,661

[45] Date of Patent: Mar. 15, 1994

[54] INTERDENTAL BRUSH HOLDER

[75] Inventor: Richard Appleby, London, England

[73] Assignee: Westone Products Limited, London, United Kingdom

[21] Appl. No.: 929,364

[22] Filed: Aug. 14, 1992

[30] Foreign Application Priority Data

Aug. 22, 1991 [GB] United Kingdom ..... 9118147

[51] Int. Cl.[5] ..... A46B 3/08; A46B 7/04

[52] U.S. Cl. ..... 15/167.1; 15/145; 15/206

[58] Field of Search ..... 15/167.1, 110, 106, 15/145, 206

[56] References Cited

U.S. PATENT DOCUMENTS

| | | | |
|---|---|---|---|
| 4,030,199 | 6/1977 | Russell | 15/206 X |
| 4,387,479 | 6/1983 | Kigyos | 15/167.1 |
| 4,572,223 | 2/1986 | Rosenfeld | 15/167.1 |
| 4,691,404 | 9/1987 | Tarrson et al. | 15/167.1 |
| 4,710,996 | 12/1987 | Tarrson et al. | 15/167.1 X |
| 4,751,761 | 6/1988 | Breitschmid | 15/167.1 |
| 4,780,923 | 11/1988 | Schultheiss | 15/167.1 |
| 5,027,358 | 7/1991 | Zimmerman | 15/167.1 |
| 5,027,467 | 7/1991 | Tarrson et al. | 15/167.1 |

FOREIGN PATENT DOCUMENTS

| | | |
|---|---|---|
| 0285765 | of 0000 | European Pat. Off. . |
| 259644 | of 0000 | Fed. Rep. of Germany . |
| 3832694 | of 0000 | Fed. Rep. of Germany . |

*Primary Examiner*—Harvey C. Hornsby
*Assistant Examiner*—Patrick F. Brinson
*Attorney, Agent, or Firm*—Larson and Taylor

[57] ABSTRACT

A brush holder for a replaceable interdental brush having a body portion and a gripping member mounted on the body portion and movable relative to it. The stem of a brush can be inserted into the holder and is retained between opposed surfaces of the body portion and gripping member. Preferably the opposed surfaces may be textured or have ribs. Optionally the holder is adapted to retain the brush in a variety of orientations.

4 Claims, 2 Drawing Sheets

INTERDENTAL BRUSH HOLDER

BACKGROUND OF THE INVENTION

1. Field of the Invention

This invention relates to holders for brushes and particularly to interdental brush holders.

2. Description of the Prior Art

A typical interdental brush has bristles extending radially from a deformable wire stem. Such brushes are not easily gripped by the user and may therefore be difficult to use. It is therefore desirable to provide a holder for such brushes.

SUMMARY OF THE INVENTION

According to the invention a brush holder for a replaceable brush is provided which has a body portion providing a handle and a gripping member which is mounted on the body portion and is movable relative to the body portion between a first condition in which the stem of a brush is insertable into and removable from the holder, and a second condition in which opposed surfaces of the gripping member and of the body portion are arranged to grip the stem of a brush inserted therebetween to prevent said removal, the brush holder being retainable in the second condition for use. One or both of the opposed surfaces may be textured or ribbed. The opposed surfaces may be generally curved or flat, with curved surfaces preferable since they provide a better grip.

The gripping member is preferably pivotally connected to the body portion, the pivotal connection preferably being at an end portion of the gripping member and of the body portion respectively. The pivotal connection may be provided by at least one cooperating stud and recess on the body portion and the gripping member.

The holder is preferably retained in said second condition by at least one cooperating stud and recess arrangement on the gripping member and the body portion, but is releasable from said condition by finger pressure on a projecting portion of the gripping member.

There are preferably a plurality of passages at non-zero angles to each other provided in an end portion of the gripping member, into which the stem of a brush is insertable. Such passages may determine the angle of a brush relative to the holder when the holder is in the closed condition. It is preferred that one such passage be substantially parallel and one substantially perpendicular to the holder when the holder is in the closed condition, so that a brush is held either substantially parallel or substantially perpendicular to the holder.

INTRODUCTION OF THE DRAWINGS

An embodiment of the invention will now be described by way of non-limitative example with reference to the accompanying drawings in which.

DESCRIPTION OF THE PREFERRED EMBODIMENT

Figure 1:
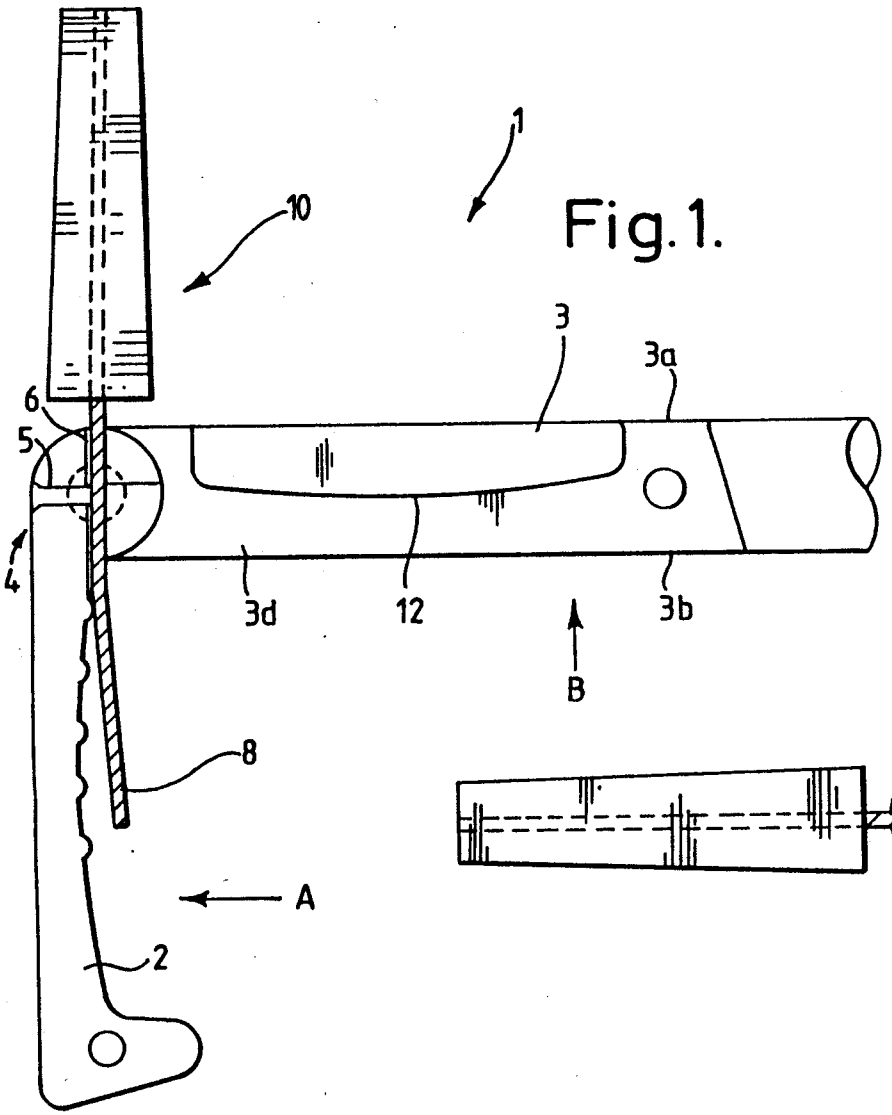
FIG. 1 shows a portion of a brush holder according to the present invention in a first condition with a brush inserted.

An interdental brush holder 1 embodying the present invention has a gripping member 2 pivotally connected to a body portion 3 at an end portion 4 thereof so that the gripping member 2 and body portion 3 are relatively movable. The body portion 3 provides a handle. The end portion 4 is laterally enlarged relative to the main body of the gripping member 2. This end portion 4 is disposed within a recess **3*d* of the body portion 3 of the holder 1. Part of such a brush holder is shown in FIGS. 1 and 2 with a brush 10** inserted therein.

The body portion 3 provides a stem gripping portion having first and second oppositely directed faces **3*a*, 3*b*. The recess 3*d* is bounded by a base surface 12 provided by the body portion 3. The gripping member 2 has a rear face 2*a* and a gripping face 14**.

The gripping member 2 has a pair of bores 5,6 substantially at right angles to each other passing through the end portion 4 for insertion of the stem 8 of a brush 10. Alternatively, there may be a single such bore or more than two bores. The bores 5,6 have flaring ends for ease of insertion of the stem 8 of a brush 10.

Figure 2:
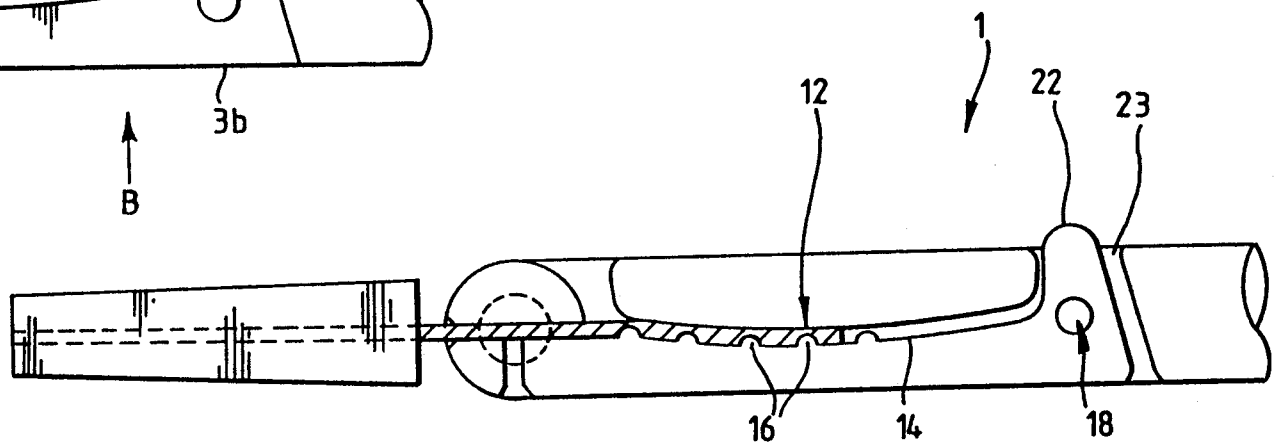
FIG. 2 shows the portion of the brush holder of FIG. 1 in a second condition.

The gripping member 2 is rotatable between the open condition shown in FIG. 1 and the closed condition shown in FIG. 2. In the closed condition, opposed surfaces 12,14 of the body portion 3 and of the gripping member 2 respectively grip the stem 8 of a brush 10 between them. The surface 14 of the gripping member 2 which opposes the surface 12 of the body portion 2 has raised ribs 16 to provide more effective grip. Either one or both of the opposed surface 12,14 may have such ridges or other texturing. In this closed condition, the two bores 5 and 6 are respectively substantially at right angles to the holder 1 and substantially parallel to the holder 1.

The gripping member 2 is retainable in the closed condition by cooperating studs 18 and recesses 20 between the body portion 3 and the end portion of the gripping member 2 which is distal from its pivotal connection to the body portion 3. In the closed condition, the gripping member 2 is housed in the recess **3*d* in the body portion 3. The gripping member 2 has a projection 22 which extends through an aperture 23 in the body portion 3 to the outside of the holder 1. Finger pressure against the projection 22** can release the gripping member from its closed condition.

Figure 3:
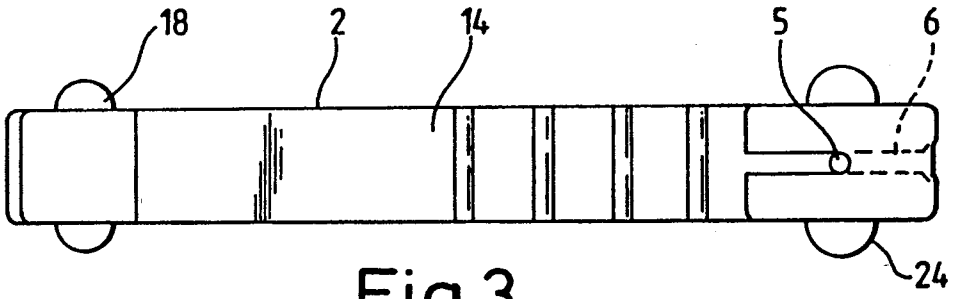
FIG. 3 shows the gripping member of FIGS. 1 and 2 viewed from the direction shown by the arrow A in FIG. 1.
Figure 4:
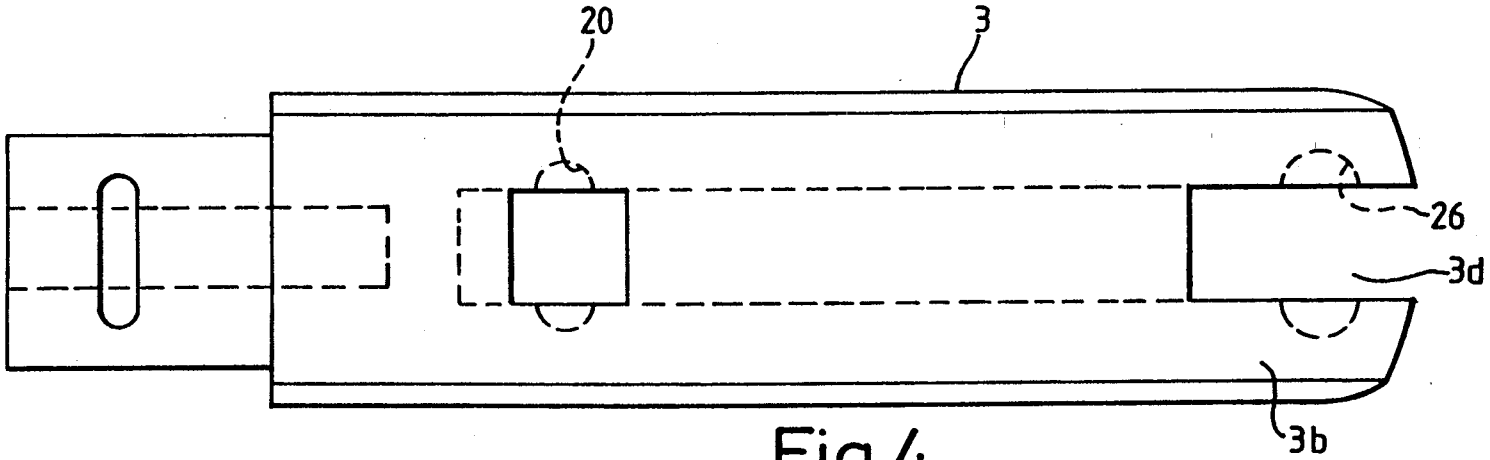
FIG. 4 shows a part of the body portion of the brush holder of FIGS. 1 and 2, viewed from the direction shown by the arrow B in FIG. 1.

The pivotal connection between the gripping member 2 and the body portion 3 is provided by cooperating studs 24 and recesses 26. This is shown in FIGS. 3 and 4. The gripping member 2 may be completely separable from the body portion 3 for example by finger pressure on the gripping member 2 in the region of its pivotal connection to the body portion 3.

The body portion 3 of the holder 1 may be formed as a plurality of parts which can be locked together, for example by cooperating studs can recesses, or alternatively as a single body.

The holder 1 may additionally be provided with a releasable cover for covering the portion of the holder incorporating the gripping member which cover may have a spring clip, as is known in writing instruments.

An example of an interdental brush holder according to the present invention has been formed with gripping member 2 having a length of 20 mm between the moulded studs 24 which form part of the pivotal connection and the moulded studs 18 of the retaining means. This length of the gripping member is preferably between 15 mm and 50 mm.

The end portion of the gripping member 2 at the pivotal connection to the body portion 3 is partially circular in cross-section perpendicular to the body portion 3, having a radius of 2.5 mm (preferred range being 2 mm to 4 mm). Moulded ribs 16 are provided at intervals of 2 mm (preferred range 1 mm to 8 mm) along the surface 14 of the gripping member 2. The body portion of the holder 1 is 127 mm in length (preferred range 90 mm to 150 mm), 10 mm in width (preferred range 8 mm to 20 mm) and 5 mm in depth (preferred range 4 mm to 10 mm).

What is claimed is:

1. A brush holder for a replaceable interdental brush of the type having a stem extending away from a brush portion, said brush holder comprising:

(a) a body portion providing a handle and having a stem gripping portion having first and second oppositely directed faces and a recess in said first face, said recess having a base surface, and (b) a gripping member rotatably mounted on said body portion so as to be movable about an axis of rotation relative to said body portion between a first condition in which said stem of a said brush is insertable into and removable from said holder and a second condition in which said gripping member is releasably located in said recess, said gripping member having on opposite sides thereof a gripping face and a rear face, said gripping face in said second condition being closely opposed to said base surface of said recess in order to grip said stem of a said brush inserted in said recess, (c) said gripping member having a width less than the width of said first face of said stem gripping portion and said gripping member and said recess of said stem gripping portion being complementarily shaped so that in said second condition said gripping member lies in said recess with said rear face thereof substantially flush with said first face of said stem gripping portion, (d) said gripping member having two stem-receiving passages at an angle to each other and each passing through said axis of rotation of said gripping member so that a said brush stem is insertable selectively in said passages of said gripping member for selection of the brush orientation relative to the brush holder, (e) said base surface of said recess and said gripping face of said gripping member clamping, in said second condition, a said brush stem inserted into the brush holder, and (f) said gripping member and said body portion having cooperating means for retaining said gripping member in said second condition for use of a said brush held by the brush holder.

2. A brush holder according to claim 1 wherein said gripping portion of said body portion has an aperture extending therethrough from said recess to said second face and said gripping member has a projection which in said second condition extends through said recess and stands proud of said second face, whereby the user can release said gripping member from said second condition by applying finger pressure on said projection towards said second face.

3. A brush holder according to claim 1 wherein said stem-receiving passages of said gripping member are at right angles to each other.

4. A brush holder according to claim 1 wherein at least one of said base surface of said recess and said gripping face of said gripping member has projections for engaging a said brush stem clamped therebetween.

* * * * *